US008511268B2

(12) United States Patent
Hoshito

(10) Patent No.: US 8,511,268 B2
(45) Date of Patent: Aug. 20, 2013

(54) ENGINE EQUIPPED WITH VARIABLE VALVE TIMING MECHANISM

(75) Inventor: Katsuni Hoshito, Hamamatsu (JP)

(73) Assignee: Suzuki Motor Corporation, Hamamatsu-Shi, Shizuoka-Ken (JP)

( * ) Notice: Subject to any disclaimer, the term of this patent is extended or adjusted under 35 U.S.C. 154(b) by 310 days.

(21) Appl. No.: 13/024,403

(22) Filed: Feb. 10, 2011

(65) Prior Publication Data

US 2011/0197840 A1 Aug. 18, 2011

(30) Foreign Application Priority Data

Feb. 15, 2010 (JP) ..... 2010-030091

(51) Int. Cl.
*F01L 1/34* (2006.01)

(52) U.S. Cl.
USPC ..... 123/90.17

(58) Field of Classification Search
USPC ..... 123/90.12, 90.17, 195 C; 464/160
See application file for complete search history.

(56) References Cited

U.S. PATENT DOCUMENTS

| | | | | |
|---|---|---|---|---|
| 4,958,537 | A * | 9/1990 | Diehl et al. | 74/606 R |
| 5,148,784 | A * | 9/1992 | Hiraoka et al. | 123/195 C |
| 5,301,639 | A * | 4/1994 | Satou | 123/90.17 |
| 5,353,755 | A * | 10/1994 | Matsuo et al. | 123/90.13 |
| 5,474,038 | A * | 12/1995 | Golovatai-Schmidt et al. | 123/90.17 |
| 5,477,817 | A * | 12/1995 | Hufendiek et al. | 123/41.33 |
| 5,950,763 | A * | 9/1999 | Ohta | 184/6.12 |
| 6,182,624 | B1 * | 2/2001 | Ozeki | 123/90.33 |
| 6,247,436 | B1 * | 6/2001 | Lancefield et al. | 123/90.38 |
| 6,263,844 | B1 * | 7/2001 | Ozeki et al. | 123/90.17 |
| 6,435,154 | B1 * | 8/2002 | Simpson et al. | 123/195 C |
| 6,568,378 | B2 * | 5/2003 | Baek | 123/572 |
| 2002/0073951 | A1 * | 6/2002 | McClure | 123/195 C |
| 2003/0145814 | A1 * | 8/2003 | Inoue | 123/90.17 |
| 2004/0007198 | A1 * | 1/2004 | Bonde et al. | 123/195 C |
| 2008/0216783 | A1 * | 9/2008 | Ando | 123/90.17 |

FOREIGN PATENT DOCUMENTS

| | | | |
|---|---|---|---|
| JP | 2008-215323 | | 9/2008 |
| JP | 2009174478 | A * | 8/2009 |

* cited by examiner

*Primary Examiner* — Kenneth Bomberg
*Assistant Examiner* — Jason T Newton
(74) *Attorney, Agent, or Firm* — Barnes & Thornburg LLP

(57) ABSTRACT

An engine is equipped with a variable valve timing mechanism, which is operated by a working oil to change rotating phase of a camshaft to thereby change the valve timing, and includes an oil passage formed in a chain case and an oil passage formed in the cylinder head so as to be communicated with the hydraulic actuator, in which the oil passages communicate with each other at a contact surface between the chain case and the cylinder head, and the working oil is supplied from the hydraulic control valve to the hydraulic actuator. The variable valve timing mechanism further includes a block disposed independent of the chain case between an inner wall of the chain case and an end wall of the cylinder head, and an intermediate oil passage formed in the block and including communication openings in which one of the communication openings is offset in position from another one thereof.

3 Claims, 8 Drawing Sheets

ENGINE EQUIPPED WITH VARIABLE VALVE TIMING MECHANISM

BACKGROUND OF THE INVENTION

1. Field of the Invention

The present invention relates to an engine equipped with a variable valve timing mechanism, which may be called hereinafter "variable valve timing mechanism-equipped engine" particularly capable of improving machinability and mountability of the variable valve timing mechanism with enhanced freedom of arrangement of an oil passage and a hydraulic control valve of the variable valve timing mechanism of the engine to be mounted on a vehicle (vehicle body).

2. Description of the Related Art

Engines to be mounted on vehicles such as automobiles include an engine equipped with a variable timing mechanism (so-called variable valve timing mechanism-equipped engine), each in which a hydraulic actuator is attached to a camshaft, and the hydraulic actuator is operated by a working oil (i.e., hydraulic oil) supplied from an hydraulic control valve attached to a chain case to thereby change rotational phase of the camshaft with respect to the crankshaft.

One common mounting method for a hydraulic control valve of a variable valve timing mechanism is a method of directly inserting a hydraulic control valve into a hydraulic control valve-attaching portion provided in a chain case. In this method, a method of forming an oil passage is generally performed in a manner such that an oil passage on a cylinder head side is formed to be opened to a surface abutting against to a chain case, and then, each oil pressure supply port of the hydraulic control valve is opened in an oil passage boss integrally formed with the chain case to thereby bring the oil passage boss of the chain case into abutment with the abutment surface of the cylinder head side, and thereby communicate each oil passage on the cylinder head side with each oil pressure supply port of the hydraulic control valve.

There is a conventional engine provided with variable valve timing mechanism in which a plurality of hydraulic control valves are mounted onto a chain case in such a way that their axis lines are oriented to be normal to and overlapped with the crankshaft lines.

Furthermore, in a conventional variable valve timing mechanism-equipped engine, there is a merit of integrally forming the oil passage to the chain case. However, the conventional variable valve timing mechanism includes a defect or drawback in which when, for instance, a plurality of hydraulic control valves are installed for supplying working oil to an intake side hydraulic actuator attached to an intake camshaft and an exhaust side hydraulic actuator attached to an exhaust camshaft, respectively, it is difficult to achieve the compatibility with the layouts of valve train accessory (auxiliary equipment) driving parts and lubrication-and-cooling passages.

For this reason, a conventional variable valve timing mechanism-equipped engine tends to involve complicated arrangements such as 3-dimensional machining working of oil passages, addition of seal plugs, and so on in order to avoid interference with objects, thereby causing an increase in machining and management cost and a quality loss in the manufacturing process.

One conventional structure of a variable valve timing mechanism of an engine is disclosed, for example, in Patent Document 1 (Japanese Patent Laid-Open Publication No. 2008-215323). In the structure of this Patent Document 1, since the oil passages of the chain case side are configured to be in direct communication with the oil passages of the cylinder head side, it is difficult to freely curve or bend the oil passage between the chain case and the cylinder head during a machining process, which therefore limits in the forming of oil passages.

Furthermore, in the structure of the Patent Document 1, since hydraulic control valves are disposed only in a limited range or space of oil passages between the chain case and the cylinder head, the hydraulic control valves cannot be freely disposed to the chain case, which provides limitation in the attaching position of the hydraulic control valves. This degrades the mountability of the hydraulic control valve to the chain case.

SUMMARY OF THE INVENTION

It is an object of the present invention to provide an engine provided with a variable valve timing mechanism (variable valve timing mechanism-equipped engine), capable of freely designing an oil passage to be curved or bent, improving the machinability of the oil passage while increasing the freedom of the arrangement of the oil passage, attaching an hydraulic control valve to an arbitrary position in a chain case regardless of the position to which the oil passage on the cylinder head side is opened to thereby improve the mountability of the hydraulic control valve to the chain case.

The above and other objects of the present invention can be achieved by providing a variable valve timing mechanism-equipped engine comprising:

a cylinder head to which a camshaft is operatively connected;

a chain case in which a timing chain for transferring rotation of a crankshaft to the camshaft is disposed;

a hydraulic actuator mounted to an end portion of the camshaft and configured to change valve timing;

a hydraulic control valve attached to the chain case covering the timing chain; and a variable valve timing mechanism operated by a working oil to change rotating phase of the camshaft to thereby change the valve timing, the variable valve timing mechanism including:

an oil passage formed in the chain case so as to be communicated with the hydraulic control valve, and an oil passage formed in the cylinder head so as to be communicated with the hydraulic actuator, in which the oil passages communicate with each other at a contact surface between the chain case and the cylinder head, and the working oil is supplied from the hydraulic control valve to the hydraulic actuator:

a block disposed independent of the chain case between an inner wall of the chain case and an end wall of the cylinder head; and an intermediate oil passage formed in the block so as to though an inside of the block and communicates between the oil passage of the chain case side and the oil passage of the cylinder head side, and the intermediate oil passage includes a communication opening that opens in a contact surface between the block and the chain case and a communication opening that opens in a contact surface between the block and the cylinder head in which one of the communication openings is offset in position from another one of the communication openings.

In a preferred embodiment of the above aspect of the present invention, it may be desired that the contact surface between the block and the chain case is formed to have an area larger than the contact surface between the block and the cylinder head, and the intermediate oil passage is formed into a groove-shaped oil passage extending from a communication opening of the intermediate oil passage to an intermediate point of the intermediate oil passage.

It may be further desired that a plurality of camshafts are disposed so as to each include a plurality of the hydraulic actuators, the hydraulic control valves and the intermediate oil passages, and the block is formed therein with a plurality of the intermediate oil passages. The intermediate oil passages may be preferably formed into a symmetric arrangement with respect to a cylinder axis line.

According to the variable valve timing mechanism-equipped engine of the present invention, the block independent of the chain case is disposed between the inner wall of the chain case and the end wall of the cylinder head, and the intermediate oil passage is formed so as to extend through the inside of the block and communicate the oil passage of the chain case side with the oil passage of the cylinder head side. Accordingly, it is possible to freely curve or bend the oil passage compared with a conventional arrangement in which an oil passage of the chain case side is directly communicated with the oil passage of the cylinder head side. Thus, according to the present embodiment, the machinability is improved while increasing the degree of freedom for the arrangement of oil passages.

Furthermore, in the variable valve timing mechanism-equipped engine of the present invention, the intermediate oil passage of the block includes a communication opening that opens in a contact surface between the block and the chain case and a communication opening that opens in a contact surface between the block with the cylinder head, and one of the communication openings is offset in position from the other communication opening, it is possible to attach an hydraulic control valve at an arbitrary position in the chain case regardless of the position to which the oil passage formed on the cylinder head side is opened, thereby improving the mountability of the hydraulic control valve onto the chain case.

The nature and further characteristic features of the present invention will be made clearer from the following descriptions made with reference to the accompanying drawings.

DESCRIPTION OF THE PREFERRED EMBODIMENT

Hereunder, a preferred embodiment of the present invention will be described with reference to the accompanying drawings of FIGS. 1 to 8, in which, it is to be noted that, terms "upper", "lower", "right", "left" and like terms indicating direction or like are used herein by wordings written on the drawings or in an illustrated attitude.

Figure 1:
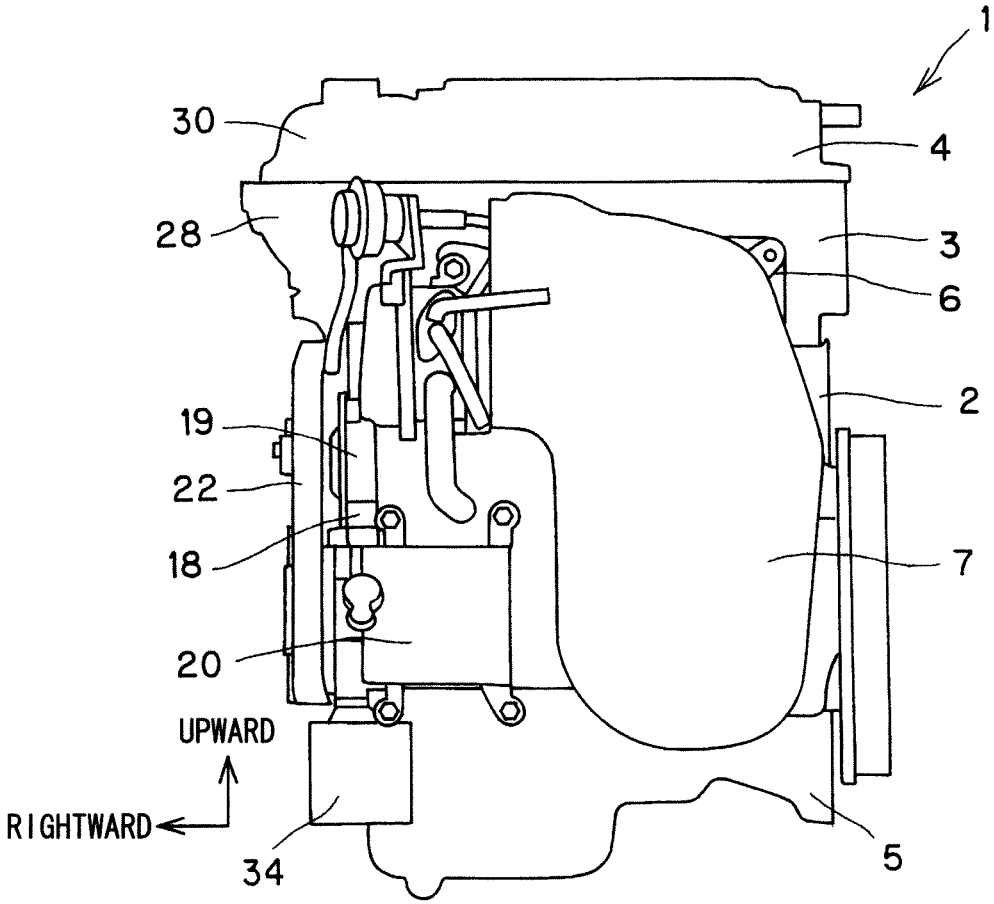
FIG. 1 is a front view of a variable valve timing mechanism-equipped engine of a vehicle according to an embodiment of the present invention.
Figure 2:
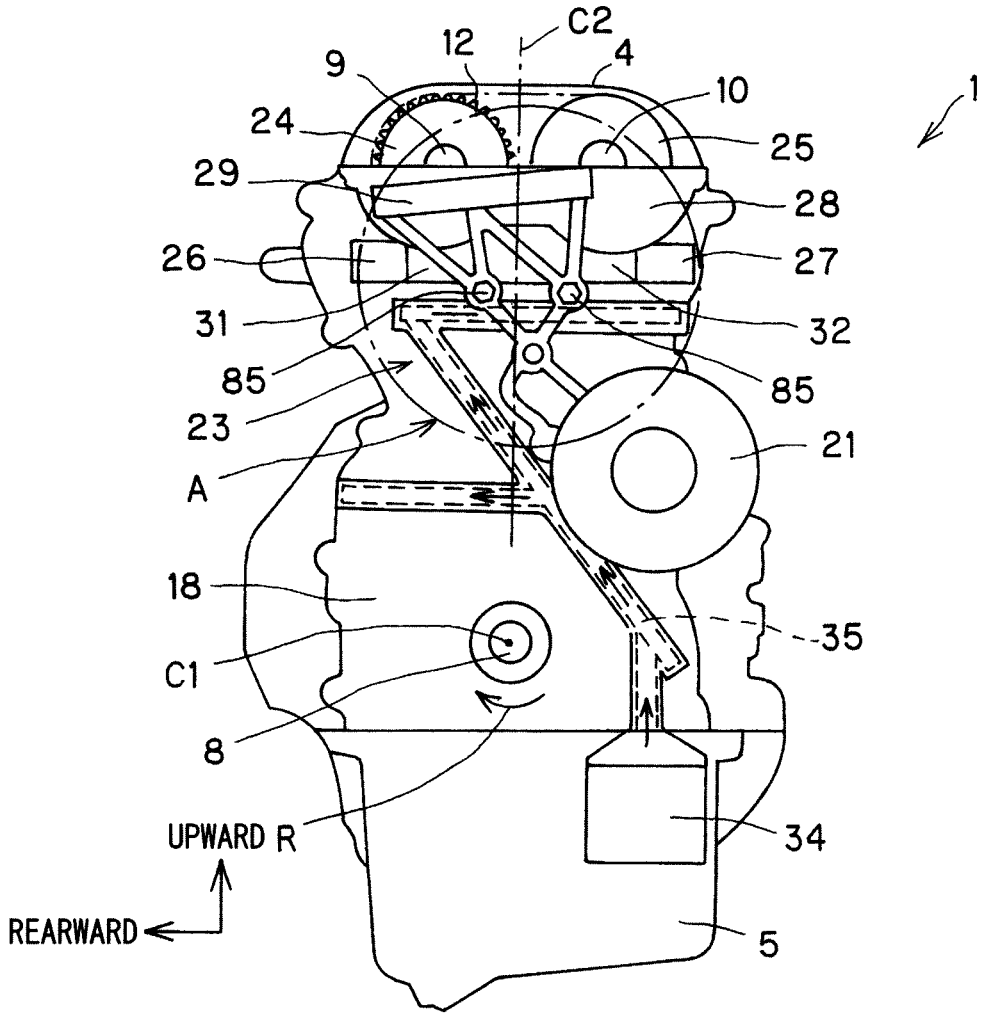
FIG. 2 is a right side view of the variable valve timing mechanism-equipped engine of FIG. 1.

With reference to FIGS. 1 and 2, reference numeral 1 denotes a horizontal-type engine provided with a variable valve timing mechanism (which may be called hereinafter "variable valve timing mechanism-equipped engine" or merely "engine") provided with a vehicle (vehicle body) of such as an automobile, for example.

In the engine 1, a cylinder head 3 is mounted to an upper portion of a cylinder block 2, the cylinder head 3 is covered with a cylinder head cover 4, and an oil pan 5 is attached to a lower portion of the cylinder block 2. The engine 1 is further configured such that an intake manifold is attached to one side (the left side in FIG. 2) of the cylinder head 3, an exhaust manifold 6 is attached to the other side (the right side in FIG. 2) of the cylinder head 3, and the exhaust manifold 6 and a catalyst are covered with an exhaust manifold cover 7.

Figure 8:
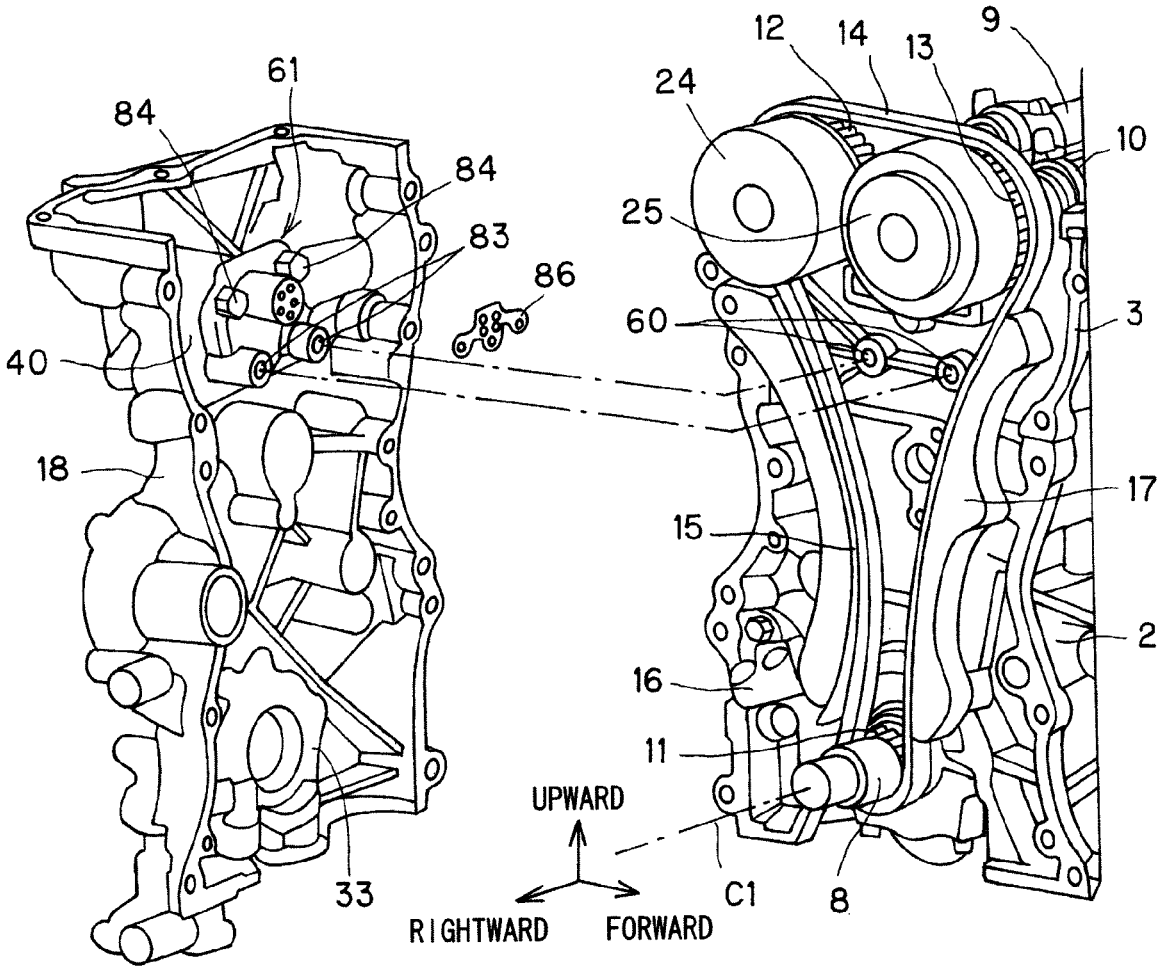
FIG. 8 is a perspective view showing a state that the chain case assembled with the block is being assembled to a cylinder block and the cylinder head.

In the engine 1, a crankshaft 8 is rotatably supported axially in the lower portion of the cylinder block 2, while a pair of intake camshaft 9 and exhaust camshaft 10 being rotatably supported axially in the cylinder head 3. In the engine 1, as shown in FIG. 8, a timing chain 14 is wound around a crank sprocket 11 attached to one end of the crankshaft 8, and an intake cam sprocket 12 and an exhaust cam sprocket 13 attached to one end of the intake camshaft 9 and the exhaust camshaft 10, respectively. The timing chain 14 transfers the rotation of the crankshaft 8 (the rotation in the direction shown by arrow R in FIG. 8) to the intake camshaft 9 and the exhaust camshaft 10, respectively, through the intake cam sprocket 12 and the exhaust cam sprocket 13 so as to rotate the intake camshaft 9 and the exhaust camshaft 10 in synchronous with the rotation of the crankshaft 8.

An appropriate tension is applied to the timing chain 14 by a chain tensions lever 15, which is provided on a loosening side (the left side in FIG. 8) with respect to the rotational direction of the crankshaft 8 in a manner pressed by a chain tension adjustor 16. Moreover, the timing chain 14 is held by a chain guide 17, which is provided on a tension side (the right side in FIG. 8) with respect to the rotational direction of the crankshaft 8 to thereby restrict deflection thereof.

The timing chain 14 is covered by a chain case 18. The chain case 18 is arranged such that both side portions in the width direction are attached to the both side portions of the cylinder block 2 and the cylinder head 3, and the upper and lower end portions are attached to the cylinder head cover 4 and the oil pan 5 when the engine 1 is seen from the axial direction C1 of the crankshaft.

As shown in FIGS. 1 and 2, in the engine 1, a water pump 19, an air conditioning compressor 20, a power steering oil pump, an alternator, and so on are arranged as accessories on both sides in the width direction of the chain case 18. These accessories, such as the water pump, are rotated by an accessory belt 22 which is wound around a crank pulley of the crank shaft 8 and an accessory pulley 21 of each accessory.

Figure 3:
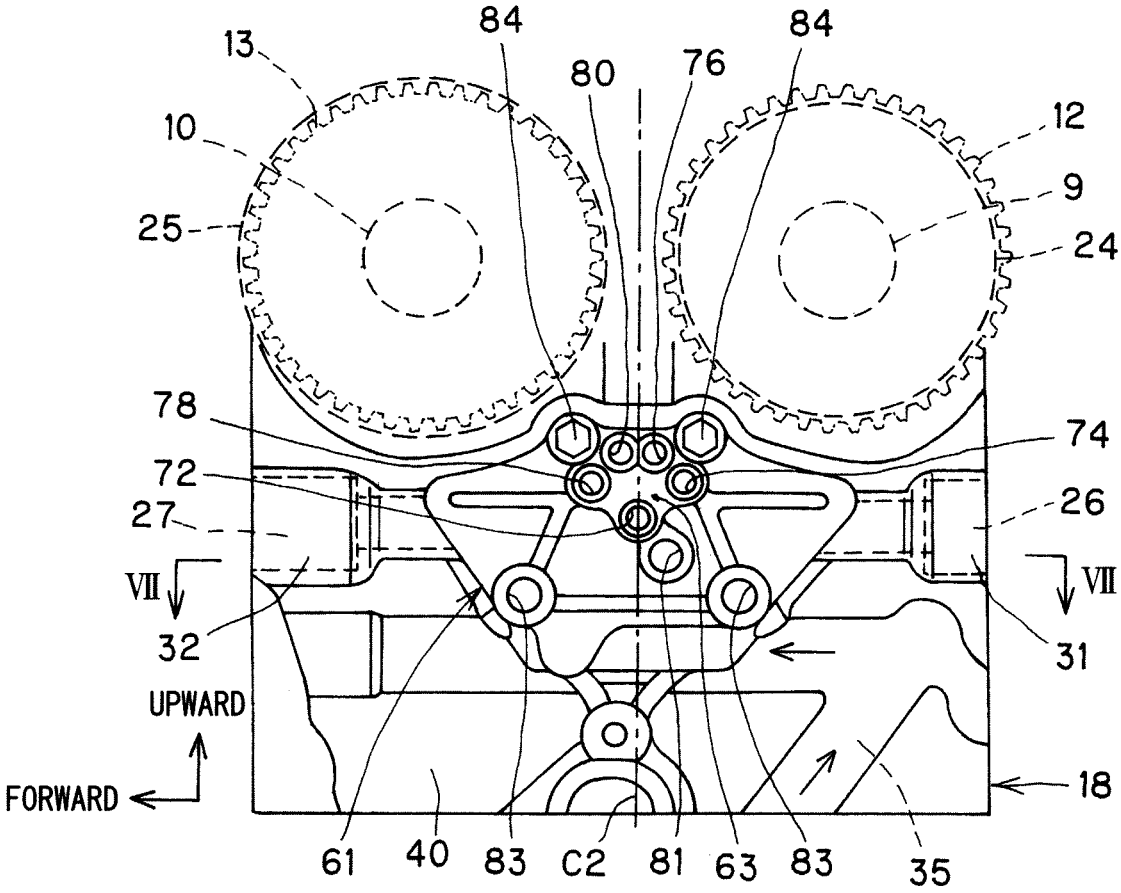
FIG. 3 is a side view seen from the engine side showing an inner wall of a chain case at a portion shown by arrow "A" in FIG. 2 with a block being assembled.

The engine 1 is equipped with a variable valve timing mechanism 23. The variable valve timing mechanism 23 has a structure, as shown in FIGS. 2 and 3, such that an intake side hydraulic actuator 24 and an exhaust side hydraulic actuator 25 are attached to an intake cam sprocket 12 and an exhaust cam sprocket 13, respectively, on one end of the intake camshaft 9 and the exhaust camshaft 10, and such that an intake side hydraulic control valve 26 and an exhaust side hydraulic control valve 27, which are operated to supply working oil (i.e., hydraulic oil) to the intake side hydraulic actuator 24 and the exhaust side hydraulic actuator 25, respectively, are attached to the chain case 18. The intake side hydraulic actuator 24 and the exhaust side hydraulic actuator 25 are operated by working oil supplied from the intake side hydraulic control valve 26 and the exhaust side hydraulic control valve 27 so as to change the rotational phases of the intake camshaft 9 and the exhaust camshaft 10 with respect to the crankshaft 8, thereby changing the valve timing.

In the chain case 18, as shown in FIGS. 1 and 2, an actuator underside cover portion 28, which covers the undersides of the intake side hydraulic actuator 24 and the exhaust side hydraulic actuator 25, is formed by being expanded in the axial direction C1 of the crankshaft, and a mount attaching portion 29 to which the engine mount is connected is formed by being expanded in the axial direction C1 of the crankshaft in an actuator cover portion 28. Moreover, in the cylinder head cover 4, an actuator upperside cover portion 30, which covers the upper sides of the intake side hydraulic actuator 24 and the exhaust side hydraulic actuator 25, is formed by being expanded in the axial direction C1 of the crankshaft.

The actuator upper-side cover portion 30 covers the upper-sides of the intake side hydraulic actuator 24 and the exhaust side hydraulic actuator 25 and is joined with the actuator underside cover portion 28 that covers the underside of the intake side hydraulic actuator 24 and the exhaust side hydraulic actuator 25.

In the chain case 18, an intake side hydraulic control valve-attaching portion 31 and an exhaust side hydraulic control valve-attaching portion 32 for respectively attaching the intake side hydraulic control valve 26 and the exhaust side hydraulic control valve 27 are formed in symmetric positions with respect to the cylinder axis line C2 in the lower portion of the actuator underside cover portion 28. The intake side hydraulic control valve-attaching portion 31 and the exhaust side hydraulic control valve-attaching portion 32 are formed in such a way that their axis lines are normal to the cylinder axis C2 and are on the same straight line, so that the intake side hydraulic control valve 26 and the exhaust side hydraulic control valve 27 are attached to be opposed to each other.

Furthermore, in the engine 1, as shown in FIG. 1, an oil pump 33 driven by the crankshaft 8 is disposed in the chain case 18. The oil pump 33 suctions and discharges the oil in the oil pan 5. The discharged oil is filtered by an oil filter 34 and fed to an oil passage 35 formed in the chain case 18 as shown in FIGS. 1 and 2. The oil passage 35 of the chain case side is in communication with the intake side hydraulic control valve 26 and the exhaust side hydraulic control valve 27 of the variable valve timing mechanism 23.

Figure 6:
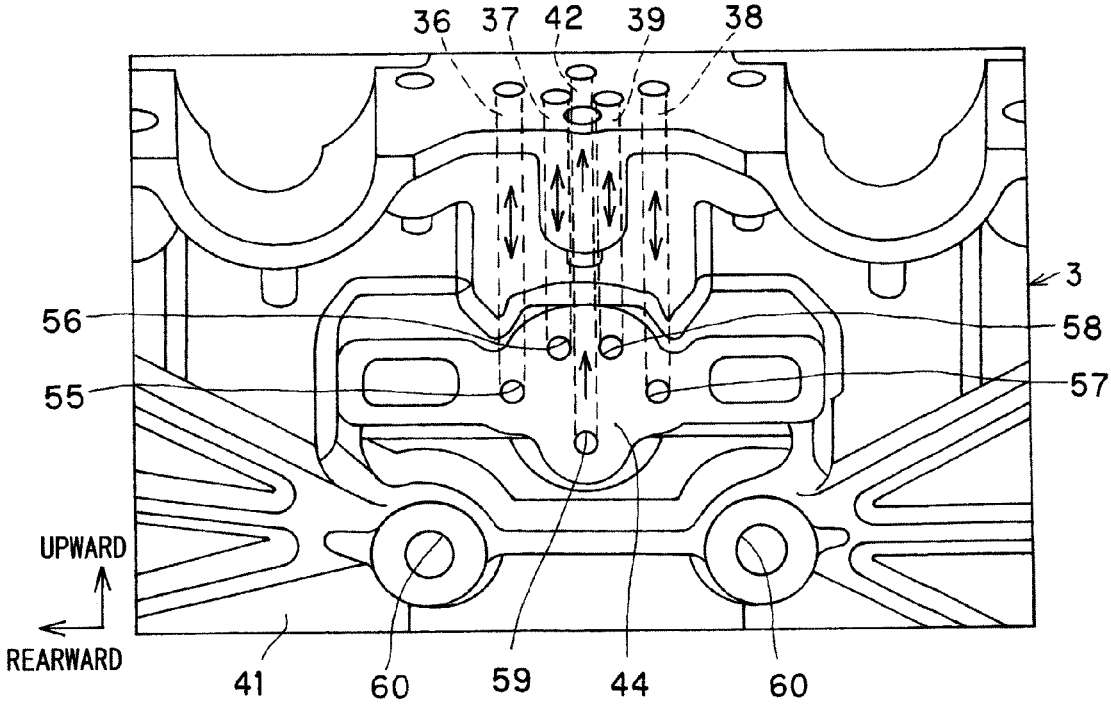
FIG. 6 is a side view seen from the chain case side showing an end wall of the cylinder head at the portion shown by arrow "A" in FIG. 2 with the block being disassembled.

Moreover, as shown in FIG. 6, the variable valve timing mechanism 23 has a structure, in which an intake side advance oil passage 36 and an intake side retard oil passage 37, and an exhaust side advance oil passage 38 and an exhaust side retard oil passage 39, which are communicated with the intake side hydraulic actuator 24 and the exhaust side hydraulic actuator 25, respectively, are formed in the cylinder head 3.

Further, the variable valve timing mechanism 23 is configured to be operated such that the oil passage 35 of the chain case 18 side and the oil passages 36 to 39 of the cylinder head 3 side are brought into communication with each other at a contact surface between an inner wall 40 (see FIGS. 3 and 4) of chain case 18 and an end wall 41 (see FIGS. 5 and 6) of the cylinder head 3 via a block 61.

In the variable valve timing mechanism 23, the oil of the oil passage 35 of the chain case 18 side is fed as working oil from the intake side hydraulic control valve 26 and the exhaust side hydraulic control valve 27 to the intake side hydraulic actuator 24 and the exhaust side hydraulic actuator 25 by way of each of the oil passages 36 to 39 of the cylinder head 3 side.

It is further to be noted that, as shown in FIG. 6, a lubrication oil passage 42 is formed in the cylinder head 3. In the engine 1, the oil passage 35 of the chain case 18 side and the lubrication oil passage 42 of the cylinder head 3 side are brought into communication at the contact surface between the inner wall 40 of the chain case 18 and the end wall 41 of the cylinder head 3 through the block 61. The oil in the oil passage 35 of the chain case 18 side is fed as lubrication oil to the lubrication oil passage 42 of the cylinder head 3 side.

Figure 4:
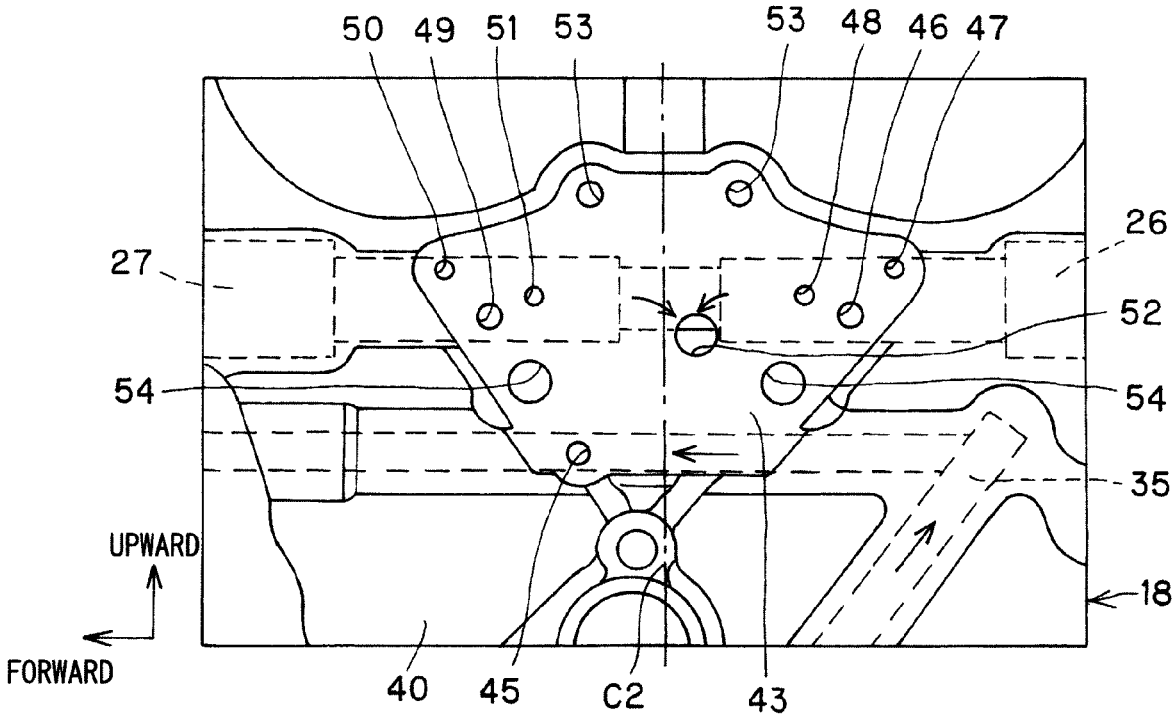
FIG. 4 is a side view seen from the engine side showing the inner wall of chain case at the site portion by arrow "A" in FIG. 2 with the block being disassembled.

The variable valve timing mechanism 23 forms a contact surface 43, as shown in FIG. 4, in the portions of the intake side hydraulic control valve 26 and the exhaust side hydraulic control valve 27 mounted to the inner wall 40 of the chain case 18, and as shown in FIG. 6, a contact surface 44 that has a smaller area than that of the contact surface 43 is also formed in the end wall 41 of the cylinder head 3 opposing to the contact surface 43 of the chain case 18.

The contact surface 43 of the chain case 18 is provided with: a communication port (opening) 45 of the oil passage 35; an intake side working oil supply port 46, an intake side advance port 47 and an intake side retard port 48 of the intake side hydraulic control valve 26; an exhaust side working oil supply port 49, an exhaust side advance port 50 and an exhaust side retard port 51 of the exhaust side hydraulic control valve 27; and a working oil discharge hole 52. Furthermore, the contact surface 43 of the chain case 18 is formed with two screw holes 53 in the upper portion thereof and two bolt through holes 54 in the lower portion thereof.

The contact surface 44 of the cylinder head 3 is provided with: a communication port (opening) 55 of the intake side advance oil passage 36 and a communication opening 56 of the intake side retard oil passage 37; a communication port (opening) 57 of the exhaust side advance oil passage 38 and a communication port (opening) 58 of the exhaust side retard oil passage 39; and a communication port (opening) 59 of the lubrication oil passage 42. Furthermore, the end wall 41 of the cylinder head 3 is formed with two screw holes 60 positioned in conformity with the two bolt through holes 54.

Figure 7:
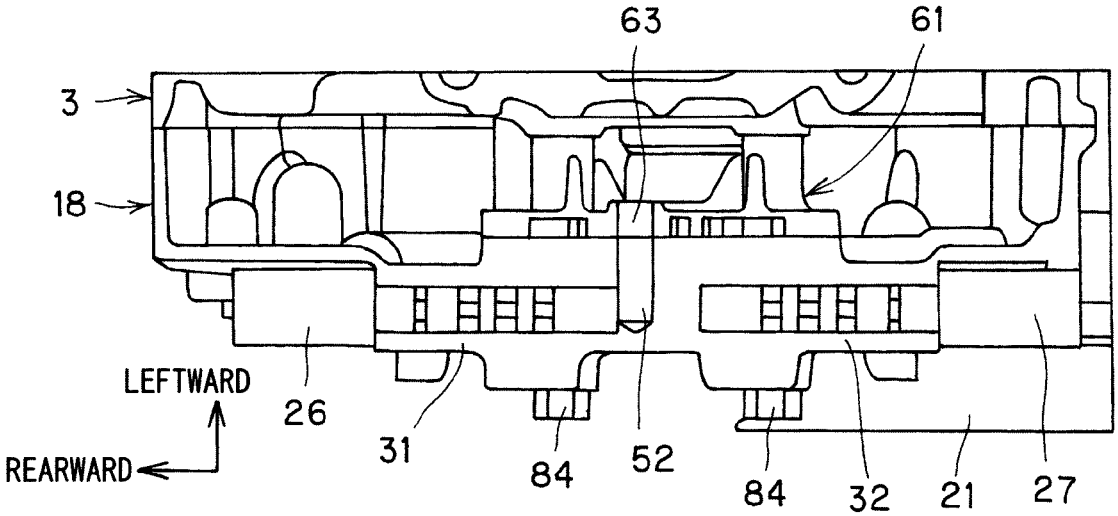
FIG. 7 is an enlarged sectional view taken along the line VII-VII of FIG. 3.

As shown in FIG. 7, the variable valve timing mechanism 23 is provide with a block 61, that is independent of the chain case 18, between the inner wall 40 of the chain case 18 and the end wall 41 of the cylinder head 3. The block 61 is provided, as shown in FIG. 5, on one side thereof, with a contact surface 62 positioned in conformity with the contact surface 43 of the chain case 18 and, as shown in FIG. 3, on the other side thereof, with a contact surface 63 positioned in conformity with the contact surface 44 of the cylinder head 3 and has a smaller area than that of the contact surface 62.

Figure 5:
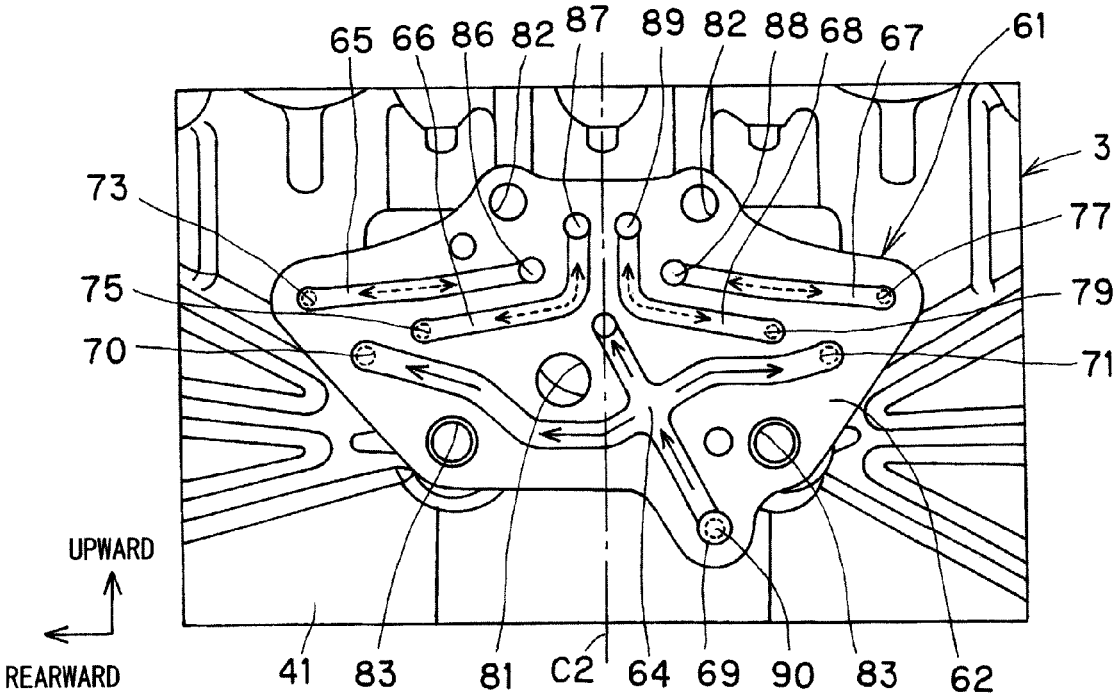
FIG. 5 is a side view seen from the chain case side showing an end wall of a cylinder head at the portion shown by arrow "A" in FIG. 2 with the block being assembled.

As also shown in FIGS. 3 and 5, the block 61 is formed with intermediate oil passages that pass through the inside of the block 61 and communicate the oil passage 35 of the chain case 18 side with the oil passages 36 to 39 and 42 of the cylinder head 3 side. The intermediate oil passages are made up of a supply side intermediate oil passage 64, an intake side advance intermediate oil passage 65, an intake side retard intermediate oil passage 66, an exhaust side advance intermediate oil passage 67, and an exhaust side retard intermediate oil passage 68.

The supply side intermediate oil passage 64 includes: a communication port (opening) 69 that opens in the contact surface 62 between the block 61 and the chain case 18 and communicates with the communication port (opening) 45; communication ports (openings) 70 and 71 that are branched in the contact surface 62 between the block 61 and the chain case 18 and respectively communicate with the intake side working oil supply port 46 and the exhaust side working oil supply port 49; and a communication port (opening) 72 that opens in the contact surface 63 between the block 61 and the cylinder head 3 and communicates with the communication port (opening) 59.

Further, the supply side intermediate oil passage 64 communicates the oil passage 35 of the chain case 18 side with the intake side working oil supply port 46 and the exhaust side working oil supply port 49, and extends through the inside of the block 61 so as to communicate with the lubrication oil passage 42 of the cylinder head 3 side.

The intake side advance intermediate oil passage 65 includes a communication port (opening) 73 that opens in the contact surface 62 between the block 61 and the chain case 18 and communicates with the intake side advance port 47, and a communication port (opening) 74 that opens in the contact surface 63 between the block 61 and the cylinder head 3 and communicates with the communication port (opening) 55. The intake side advance intermediate oil passage 65 communicates the intake side advance port 47 with the intake side advance oil passage 36.

The intake side retard intermediate oil passage 66 includes a communication port (opening) 75 that opens in the contact surface 62 between the block 61 and the chain case 18 and communicates with the intake side retard port 48, and a communication port (opening) 76 that opens in the contact surface 63 between the block 61 and the cylinder head 3 and communicates with the communication port (opening) 56. The intake side retard intermediate oil passage 66 communicates the intake side retard port 48 with the intake side retard oil passage 37.

The exhaust side advance intermediate oil passage 67 includes a communication port (opening) 77 that opens in the contact surface 62 between the block 61 and the chain case 18 and communicates with the exhaust side advance port 50, and a communication port (opening) 78 that opens in the contact surface 63 between the block 61 and the cylinder head 3 and communicates with the communication port (opening) 57. The exhaust side advance intermediate oil passage 67 communicates the exhaust side advance port 50 with the exhaust side advance oil passage 38.

The exhaust side retard intermediate oil passage 68 includes a communication port (opening) 79 that opens in the contact surface 62 between the block 61 and the chain case 18 and communicates with the exhaust side retard port 51, and a communication port (opening) 80 that opens in the contact surface 63 between the block 61 and the cylinder head 3 and communicates with the communication port (opening) 58. The exhaust side retard intermediate oil passage 68 communicates the exhaust side retard port 51 with the exhaust side retard oil passage 39.

The intermediate oil passage, which is made up of the intake side advance intermediate oil passage 65 and the intake side retard intermediate oil passage 66, and the exhaust side advance intermediate oil passage 67 and the exhaust side retard intermediate oil passage 68, is configured such that the communication ports 73, 75, 77 and 79 on one side (FIG. 5) which open in the contact surface 62 are offset from the positions opposing to the communication ports 74, 76, 78 and 80 on the other side (FIG. 3) which open in the contact surface 63.

Furthermore, the intermediate oil passages 65 to 68 are arranged in a symmetric manner with respect to the cylinder axis line C2.

The block 61 is formed with: a working oil discharge port (opening) 81 that communicates with the working oil discharge port (opening) 52 of the chain case 18; two bolt through holes 82, which conform to the screw holes 53, in an upper portion thereof; and two bolt through holes 83, which conform to the bolt through holes 54 and the screw holes 60 in a lower portion thereof. The block 61 is attached to the inner wall 40 of the chain case 18 by abutting the contact surface 62 of one side against the contact surface 43 of the chain case 18 and screwing an attaching bolt 84, which is inserted into the bolt through hole 82, into a screw hole 53 of the chain case 18.

The block 61, which has been thus attached to the chain case 18, is attached to the engine 1 by screwing the attaching bolt 85, which is inserted into the bolt through hole 54 of the chain case 18 and the bolt through hole 83 of the block 61, into the screw hole 60 of the cylinder head 3.

The variable valve timing mechanism 23 is configured to communicate the oil passage 35 of the chain case 18 side with the oil passages 36 to 39 of the cylinder head 3 side through the respective intermediate oil passages 65 to 68 formed in the block 61 so as to supply the oil of the oil passage 35, as working oil, from the intake side hydraulic control valve 26 and the exhaust side hydraulic control valve 27 to the intake side hydraulic actuator 24 and the exhaust side hydraulic actuator 25. The working oil discharged from the intake side hydraulic control valve 26 and the exhaust side hydraulic control valve 27 flows out from the working oil discharge port 52 of the chain case 18 through a working oil discharge port 81 of the block 61 and falls into the chain case 18, thus returning to the oil pan 5. It is noted that in FIG. 8, reference numeral 86 denotes a seal gasket that seals a portion between the contact surface 63 of the block 61 and the contact surface 44 of the cylinder head 3.

Further, the oil in the oil passage 35 of the chain case 18 side is supplied as lubricant oil to the lubrication oil passage 42 of the cylinder head 3 side through the supply side intermediate oil passage 64 of the block 61 so as to lubricate the intake camshaft 9 and the exhaust camshaft 10. It is noted that in the contact surface 62 of the block 61 with the chain case 18, the supply side intermediate oil passage 64, which extends from the communication opening 69 that opens in the contact surface 62 to the communication openings 70 and 71 that communicate with the intake side working oil supply port 46 and the exhaust side working oil supply port 49 respectively, is formed into a groove-shaped oil passage.

As mentioned above, the engine 1 equipped with the variable valve timing mechanism 23 is configured such that the block 61 which is independent of the chain case 18 is disposed between the inner wall 40 of the chain case 18 and the end wall 41 of the cylinder head 3, and the intermediate oil passages 65 to 68 that pass through the inside of the block 61 and communicate the oil passage 35 of the chain case 18 side with the oil passages 36 to 39 of the cylinder head 3 side are formed in the block 61 are formed. Accordingly, it becomes possible to freely curve or bend the oil passages, thereby improving the machinability of the oil passages while increasing the freedom of the arrangement thereof, in comparison with a conventional arrangement in which the oil passage 35 of the chain case 18 side is directly communicated with the oil passages 65 to 68 of the cylinder head 3 side.

Moreover, in the described embodiment, the engine 1 equipped with the variable valve timing mechanism 23 is configured such that the intermediate oil passages 65 to 68 in the block 61 include the communication openings 73, 75, 77 and 79 that open in the contact surface 62 between the block 61 and the chain case 18, and the communication openings 74, 76, 78 and 80 that open in the contact surface 63 between the block 61 and the cylinder head 3, and the communication openings 73, 75, 77 and 79 on one side are offset respectively from the positions opposing to the communication openings 74, 76, 78 and 80 on the other side in the direction away from the cylinder axis line C2. Accordingly, it is made possible to attach the intake side hydraulic control valve 26 and the exhaust side hydraulic control valve 27 to arbitrary positions in the chain case 18 regardless of the positions to which the oil passages formed on the cylinder head 3 side are opened, thereby improving the mountability of the hydraulic control valves to the chain case 18.

Still furthermore, in the variable valve timing mechanism 23 of the embodiment, as shown in FIGS. 3 and 5, the area of the contact surface 62 between the block 61 and the chain case 18 is larger than that of the contact surface 63 of the block 61 and the cylinder head 3. In the contact surface 62 between the block 61 and the chain case 18, the intermediate oil passages 65 to 68 are formed into an oil passage, groove-shaped in section, from the communication openings 73, 75, 77 and 79 thereof opened in the contact surface 62 to intermediate points 87 to 90 of the intermediate oil passages 65 to 68.

That is, in the contact surface 62 of the block 61 with the chain case 18, the intake side advance intermediate oil passage 65 is formed into a groove-shaped oil passage from the communication opening 73 to the intermediate point 87 of the intake side advance intermediate oil passage 65, which is located at the position opposing to the communication opening 74. In the contact surface 62 between the block 61 and the chain case 18, the intake side retard intermediate oil passage 66 is formed into a groove-shaped oil passage from the communication opening 75 to the intermediate point 88 of the intake side retard intermediate oil passage 66, which is located at the position opposing to the communication opening 76 that opens in the contact surface 63.

In the contact surface 62 between the block 61 and the chain case 18, the exhaust side advance intermediate oil passage 67 is formed into a groove-shaped oil passage from the communication opening 77 to the intermediate point 89 of the exhaust side advance intermediate oil passage 67, which is located at the position opposing to the communication opening 78.

In the contact surface 62 between the block 61 and the chain case 18, the exhaust side retard intermediate oil passage 68 is formed into a groove-shaped oil passage from the communication opening 79 to the intermediate point 90 of the exhaust side retard intermediate oil passage 68, which is located at the position opposing to the communication opening 80.

According to the arrangement in which the area of the contact surface 62 is larger than the contact surface 63, the engine 1 equipped with the variable valve timing mechanism 23 can make the communication openings 73, 75, 77 and 79 of the intermediate oil passages 65 to 68 that communicate with the oil passages 35 of the chain case 18 side substantially offset from the positions opposing to the communication openings 74, 76, 78 and 80 of the intermediate oil passages 65 to 68 that communicate with the oil passages 36 to 39 of the cylinder head 3 side, and accordingly, it becomes possible to expand or widen the region of the chain case 18 to which the intake side hydraulic control valve 26 and the exhaust side hydraulic control valve 27 are mounted.

Moreover, since the intermediate oil passages 65 to 68 are formed into a groove-shaped oil passage from the communication openings 73, 75, 77 and 79 to the intermediate points 87 to 90 of the intermediate oil passages 65 to 68 in the contact surface 62, the engine 1 equipped with the variable valve timing mechanism 23 can improve the productivity of the intermediate oil passages 65 to 68. Similarly, since the supply side intermediate oil passage 64 is formed into a groove-shaped oil passage from the communication opening 69 to the communication opening 70 and the communication opening 71, the engine 1 equipped with the variable valve timing mechanism 23 can improve the productivity of the supply side intermediate oil passage 64.

The engine 1 equipped with the variable valve timing mechanism 23 of the present embodiment includes: a plurality of camshafts including the intake camshaft 9 and the exhaust camshaft 10 as shown in FIGS. 1 and 2; a plurality of hydraulic actuators, a plurality of hydraulic control valves and a plurality of intermediate oil passages including the intake side hydraulic actuator 24 and exhaust side hydraulic actuator 25, the intake side hydraulic control valve 26 and the exhaust side hydraulic control valve 27, and the intermediate oil passages 65 to 68; and a plurality of intermediate oil passages 65 to 68 in the inside of the block 61 as shown in FIGS. 3 and 5.

According to the structure and arrangement mentioned above, the engine 1 equipped with the variable valve timing mechanism 23 of the present embodiment makes it possible to attach a plurality of hydraulic control valves 26 and 27 to arbitrary positions of the chain case 18 by means of a single block 61.

Moreover, the engine 1 equipped with the variable valve timing mechanism 23 of the present embodiment makes it possible to integrate a plurality of intermediate oil passages 65 to 68 into a single block 61 so as not to interfere with each other and in a compact arrangement, thereby reducing the space occupied by the block in comparison with the case in which one block is used for each hydraulic control valve 26, 27.

Furthermore, the engine 1 equipped with the variable valve timing mechanism 23 of the present embodiment makes it possible to dispose a plurality of hydraulic control valves including the intake side hydraulic control valve 26 and the exhaust side hydraulic control valve 27 at symmetric positions with respect to the cylinder axis line C2 by forming a plurality of intermediate oil passages 65 to 68 into a symmetric arrangement with respect to the cylinder axis line C2 as shown in FIGS. 3 and 5.

According to the variable valve timing mechanism of the described embodiment, a plurality of the hydraulic control valves including the intake side hydraulic control valve 26 and the exhaust side hydraulic control valve 27 can be disposed at the same height in the engine 1, and therefore, the engine 1 equipped with the variable valve timing mechanism 23 can improve the working efficiency of the workers mounting (attaching) the hydraulic control valves.

Moreover, since the shapes of the intermediate oil passages 65 to 68 in the block 61 are simplified by forming the intermediate oil passages 65 to 68 to be symmetric with respect to the cylinder axis line C2, the engine 1 equipped with the variable valve timing mechanism 23 makes it possible to reduce the machining time and thus improve the machinability of the intermediate oil passages 65 to 68 in the block 61 as the result of the simplification thereof.

Furthermore, by placing the mesh filter 91 between the supply side intermediate oil passage 64 of the block 61 and the oil passage 35 of the chain case 18 (just after a main gallery) as shown in FIG. 5, the engine 1 equipped with the variable valve timing mechanism 23 makes it possible to trap impurities for the entire oil supply to the variable valve timing mechanism 23 and the cylinder head 3 by a single mesh filter 91.

Consequently, as mentioned hereinabove, according to the variable valve timing mechanism-equipped engine of the preferred embodiment of the present invention, the oil passages can be freely designed to be curved or bent, thus expanding the region of the chain case to which an hydraulic control valve can be attached by disposing a block between the chain case and the cylinder head and forming an intermediate oil passage therein. In addition, similar effects can be achieved by disposing a block formed with an intermediate oil passage between the cylinder head cover and the cylinder head, when attaching a plurality of hydraulic control valves to the cylinder head cover.

It is further to be noted that the present invention is not limited to the described preferred embodiment, and may other changes and modifications may be made without departing from the scopes of the appended claims.

What is claimed is:

1. A variable valve timing mechanism-equipped engine comprising:

a cylinder head to which a camshaft is operatively connected;

a chain case in which a timing chain for transferring rotation of a crankshaft to the camshaft is disposed;

a hydraulic actuator mounted to an end portion of the camshaft and configured to change valve timing;

a hydraulic control valve attached to the chain case covering the timing chain; and a variable valve timing mechanism operated by a working oil to change rotating phase of the camshaft to thereby change the valve timing, the variable valve timing mechanism including:

an oil passage formed in the chain case so as to be communicated with the hydraulic control valve, and an oil passage formed in the cylinder head so as to be communicated with the hydraulic actuator, in which the oil passages communicate with each other at a contact surface between the chain case and the cylinder head, and the working oil is supplied from the hydraulic control valve to the hydraulic actuator;

a block disposed independent of the chain case between an inner wall of the chain case and an end wall of the cylinder head, in which the contact surface between the block and the chain case is formed to have an area larger than the contact surface between the block and the cylinder head; and an intermediate oil passage formed in the block through an inside of the block, which communicates between the oil passage of the chain case side and the oil passage of the cylinder head side, wherein the intermediate oil passage includes a communication opening that opens on a contact surface between the block and the chain case, wherein the intermediate oil passage communicates with a port of the hydraulic control valve, and also includes a communication opening that opens on a contact surface between the block and the cylinder head in the block, wherein, the intermediate oil passage communication opening on the contact surface between the block and the chain case in the block is offset away from an intersection of a cylinder axis and a position opposite the communication port of the hydraulic control valve, wherein the intermediate oil passage is formed in the contact surface between the block and the chain case so as to provide a groove-shaped oil passage extending from the communication opening on the contact surface between the block and the chain case to a position opposite the communication opening on the contact surface of the block and the cylinder head.

2. The variable valve timing mechanism-equipped engine of claim 1, wherein the camshaft is made up of a plurality of camshafts each including a plurality of the hydraulic actuators, the hydraulic control valves and the intermediate oil passages, and the block is formed therein with a plurality of the intermediate oil passages.

3. The variable valve timing mechanism-equipped engine of claim 2, wherein the intermediate oil passages are formed into a symmetric arrangement with respect to a cylinder axis line.

* * * * *